United States Patent [19]

Shaginian et al.

[11] Patent Number: 4,591,007

[45] Date of Patent: May 27, 1986

[54] WELL TUBING HANDLING APPARATUS

[75] Inventors: Albert S. Shaginian; Anatoly A. Pevnev; Alexei G. Asan-Dzhalalov; Alexandr P. Androsenko; Leonid N. Palkin; Elena I. Klimovich, all of Gomel, U.S.S.R.

[73] Assignee: Spetsialnoe Konstruktorskoe Bjuro Seismicheskoi Tekhniki, Gomel, U.S.S.R.

[21] Appl. No.: 468,485

[22] Filed: Feb. 22, 1983

[51] Int. Cl.[4] ..... E21B 19/15; E21B 19/16

[52] U.S. Cl. ..... 175/85; 166/77.5; 166/85; 175/52; 414/22

[58] Field of Search ..... 175/85, 52; 166/85, 166/77, 77.5, 78; 81/57.16, 57.18, 57.24, 57.25, 57.34, 57.35; 414/22

[56] References Cited

U.S. PATENT DOCUMENTS

| | | | |
|---|---|---|---|
| 1,564,511 | 12/1925 | Bessolo | 81/57.35 |
| 2,450,934 | 10/1948 | Calhoun | 166/77.5 |
| 2,668,689 | 2/1954 | Cormany | 81/57.16 |
| 3,177,944 | 4/1965 | Knights | 166/77.5 |
| 3,545,313 | 12/1970 | Kelley | 81/57.34 |
| 3,734,210 | 5/1973 | Wilderman | 175/85 |
| 4,128,135 | 12/1978 | Mitchhart et al. | 175/52 |
| 4,303,270 | 12/1981 | Adair | 414/22 X |
| 4,348,920 | 9/1982 | Boyadjieff | 81/57.25 |
| 4,403,666 | 9/1983 | Willis | 175/85 |
| 4,440,220 | 4/1984 | McArthur | 166/85 |

FOREIGN PATENT DOCUMENTS

| | | | |
|---|---|---|---|
| 1258673 | 8/1961 | France . | |
| 2083106 | 3/1982 | United Kingdom | 175/52 |
| 236377 | 6/1969 | U.S.S.R. . | |
| 574517 | 9/1977 | U.S.S.R. . | |

*Primary Examiner*—James A. Leppink
*Assistant Examiner*—Hoang C. Dang
*Attorney, Agent, or Firm*—Fleit, Jacobson, Cohn & Price

[57] ABSTRACT

The apparatus includes a mast, an elevator and a tubing spider for suspending a string of well tubes or rods, a rack for storing well tubes or rods, a manipulator and a swivel head for screwing and unscrewing the string carried by the manipulator boom. To axially align the last tube or rod with the string the apparatus is provided with centering guides for centering the upper and the lower ends of the tube or rod and a gripping device for gripping the upper end of the string. The centering guide for centering the upper end of a well rod or tube forms part of a lifting frame, which in turn is a constituent of the elevator for suspending a string of well tubes or rods. The centering guide for centering the lower end of the rod or tube forms part of an automatic tong assembly for making up and breaking out joints of rods, which assembly is used with the claimed apparatus and also comprises the swivel head and the means for gripping the upper end of the string of well tubes or rods.

1 Claim, 13 Drawing Figures

WELL TUBING HANDLING APPARATUS

BACKGROUND OF THE INVENTION

1. Field of the Invention

The invention relates to the art of oil well drilling and to well drilling equipment particularly to well tubing handling apparatus preferably used in well servicing.

2. Description of the Prior Art

In oil recovery practice well servicing is a routine procedure comprising handling well elements, such as pipe, tubing and rods, going into and coming out of a well.

In handling well elements use is made of a mobile apparatus generally comprising hoisting means, gripping and rotating means for screwing and unscrewing the joints on a string of drill tubes or rods. Since well servicing is conducted on an operating well, efficiency is not least important. Well servicing time in repairs also includes the time for raising and lowering tubing strings and in all instances it is desirable to reduce this time to the minimum. The quest for time reduction in performing the above operations has led to the development of apparatus wherein all or most of the operations are automated.

The hoisting means in such apparatus generally comprises a mast arranged by the well bore and a hoisting drive usually including a rope-and-pulley system mounted on the mast. To suspend the string of drill tubes or rods use generally is made of a corresponding upper means, such as elevators and a lower means, such as spiders, one or several lifting frames being suspended from the pulley block of the hoisting drive.

Well servicing equipment also includes a means for storing drill tubes or rods usually in the form of racks located near the well bore and a means for transferring well tubes or rods from the racks to the well bore incorporating a manipulator.

To screw and unscrew the joints of a well string the apparatus comprises suitable arrangements variously constructed as well as disposed.

Known in the art is an apparatus for handling well elements disclosed in French Pat. No. 1,258,673 and comprising a swivel head to screw and unscrew the joints of a well string, the swivel head including driven and pressure rollers mounted at the end of a boom pivoted to the platform for orienting the well tube, following its transfer by the manipulator from the storage racks to the mast, into alignment with the well bore.

Another prior art apparatus of the kind disclosed (Inventor's Certificate of the USSR No. 574,517) comprises an automatic rotary tong assembly and a swivel head both mounted above the spider and by the side of a well bore.

One more prior art apparatus as disclosed in Inventor's Certificate of the USSR No. 236,377 comprises an automatic rotary tong assembly which is a self-gripping and double-acting swivel head mounted directly on the spider (rod adapter) and in alignment with the well bore.

In all the apparatus mentioned above the screwing and unscrewing operation is characterized by a low efficiency.

As regards the above-mentioned French patent a well tube is actually centered in the swivel head and aligned with the well string held in the gripping means of the drill platform but this alignment is achieved by rotating the boom of the swivel head thus consuming time and this rotation does not coincide with either raising and lowering operations or rotation of the manipulator. Moreover the above apparatus is designed for use with tubes only and cannot be used with well rods.

In the apparatus according to the Soviet Inventor's Certificate No. 574,517 both applying of the tongs on the well string and accurate alignment of the well elements making up the well string, performed by hand, require additional time.

In the apparatus according to the Soviet Inventor's Certificate No. 236,377 the tongs are substantially aligned with the well bore to exclude extra time for their application and make for convenience in unscrewing the well string. However lack of rigid guiding means for a tube or rod in screwing the well string makes it difficult for the tube or rod to pass the tongs opening and the speed of lowering the same tube or rod is to be reduced.

Also, in this apparatus a tube or rod is to be lowered or raised half the vertical travel distance with the height of the tongs inclusive in screwing and unscrewing the well string, respectively so that time consumed for travelling the distance equal to the height of the tongs is to be added to that required for the reduction in the tube lowering speed.

SUMMARY OF THE INVENTION

A general object of the invention is the provision of a well tubing handling apparatus offering improved efficiency in the tubing lowering and raising operations due to a reduction in time for screwing and unscrewing the well string.

Another object of the invention is the provision of a frame for lifting well rods, which is more reliable in operation and contributing to higher speeds in screwing and unscrewing the well strings.

Yet another object of the invention is the provision of a more efficient automatic tong assembly for making up and breaking out joints of well rods for use in a well tubing handling apparatus.

Higher reliability in the screw joints of the well string is among the objects of the invention.

The invention resides in the improvement in an apparatus for handling well rods or tubes hereinafter referred to as elongated well elements or rod-like elongated well elements, which apparatus comprising a mast arranged at the well bore, an upper means for suspending a string of elongated well elements and movably mounted on the mast and kinematically connected with a hoisting means, a lower means for suspending a string of elongated well elements immovably mounted above the well head, a means for storing elongated well elements arranged beside the well head, a manipulator with a rotating boom mounted on a base member and carrying a clamp means with coaxial grippers for holding an elongated well element as it is transferred by the manipulator from the means for storing elongated well elements to the upper means for suspending a string of elongated well elements, and a swivel head for screwing and unscrewing a string of elongated well elements.

According to the invention, the boom of the manipulator is provided with a means for gripping the upper end of a string of elongated well elements and adapted for lateral elastic displacement on the same boom and with a means for gripping and centering the lower end of an elongated well element, in this case the swivel head is mounted on the boom for longitudinal elastic displacement with respect to the means for gripping the upper end of a well string. The means for gripping the upper end of a string of elongated well elements is mounted on the boom so that with the same boom in an operating position (an elongated well element is aligned with the well bore) the same means is disposed between its clamp means and the lower means for suspending a string of elongated well elements. This means comprises at least one pair of power-driven gripping jaws arranged so as to define an opening in their closed position, which opening is coaxial with the grippers of the clamp means. The means for gripping and centering the lower end of an elongated well element has at least one pair of power-driven centering jaws. These gripping means are mechanically coupled so that openings defined by their jaws on closing are coaxial. Furthermore, according to the invention the mast has guides whereon the means for centering the upper end of an elongated well element is movably mounted.

The apparatus hereinabove described provides for a preliminary (prior to screwing) and accurate axial alignment of a well tube or rod with the well string while the manipulator boom rotates. In doing this the screwing-and-unscrewing time is reduced not only due to a reduction in auxiliary time (in prior art apparatus this time is required either for setting the swivel head to an operative position or for an additional lowering of a tube or rod through the height of the swivel head as has already been mentioned) but also due to an increase in the speed of lowering during approaching of the elongated well elements to be connected and due to an increase in the speed of screwing and unscrewing a drill string of such elements.

The invention also resides in the provision of a frame for lifting well rods comprising: a cross-piece having a downwardly open groove and an opening provided on the axis of symmetry of the groove, a pair of oppositely-acting, spring-loaded clamp jaws pivotably received in the groove of the cross-piece, a hollow plunger rigidly secured in the opening of the cross-piece, and having a collar portion acting as a piston provided on the upwardly extending portion, a split sleeve axially movable on the plunger and having a portion of an inner diameter corresponding to the outer diameter of the collar portion of the plunger defining a space to be filled with a pressure fluid, whereby the sleeve assembled with the plunger forms a power cylinder, link members for providing a kinematic connection of the sleeve with the clamp jaws, each of the link members being pivoted to the sleeve with one of its ends and to a respective one of the clamp jaws with the other, and a centering guide for the upper end of a well rod rigidly connected to the cross - piece and arranged above the pair of clamp jaws.

As a part of the apparatus described above such a lifting frame acting as the upper means for suspending a rod string and having a means for centering the upper end of a well rod (a centering guide) mounted on the cross-piece provided for an increase in the speed of rotation of a well rod while screwing and unscrewing a well string. Also, due to the centering of the upper end of a well rod the gripping jaws give a more reliable grip on the rod thus increasing safety in suspending a well rod or especially a well string by means of the lifting frame. The latter advantage is also retained when the same lifting frame is used on any other well tubing handling apparatus.

With the end of providing a simpler centering guide the latter is preferably made in the form of a bush to be secured on the plunger by a bayonet lock.

The invention also provides an automatic tong assembly for making up and breaking out joints of well rods, which comprises a lock means having a substructure and a means for gripping the upper end of a string of well rods, mounted on the substructure; a centering guide mounted on the substructure of the lock means in axial alignment of the lock means in axial alignment with the gripping means thereof, and a swivel head mounted on the substructure of the lock means for longitudinal displacement. The swivel head of the tong assembly comprises a frame, a means for gripping the rod neck mounted on the frame, a power-driven reversible means mounted substantially in the frame and kinematically connected with the means for gripping the rod neck, and a spring means for holding the swivel head on the substructure and enabling the same swivel head to make longitudinal elastic displacements, the spring means having mechanical connection with the frame and with the substructure of the lock means.

Such an arrangement of the automatic tong assembly for making up and breaking out joints of well rods on the apparatus herein above described provides for an accurate axial alignment of a well rod with a well string which feature is beneficial for an increase in the speed of lowering a well rod in making a screw joint with a well string, in the speed of rotation of a well rod in screwing and unscrewing of a well string and makes it possible to make more reliable screw joints and therefore minimize the risk of screw damage during operation.

If the same tong assembly is used on another apparatus which does not have a means for centering the upper end of a well rod, the above recited advantages are largely felt since a length-to-diameter ratio in a well rod is usually high and an axial misalignment of its upper end and a well string does not have as great an effect on the quality characteristics of a screw joint as misalignment of the lower end of a well rod does.

To simplify the construction and to provide for a single drive unit operation gripping means of the lock means is preferably made in the form of power-driven gripping jaws pivoted to the substructure and the centering guide is arranged over the swivel head and comprises centering jaws rigidly connected to the power-driven gripping jaws through vertical columns.

BRIEF DESCRIPTION OF THE DRAWINGS

Now the invention is described by way of specific embodiments thereof with reference to the accompanying drawings in which.

DETAILED DESCRIPTION OF THE INVENTION

Figure 1:
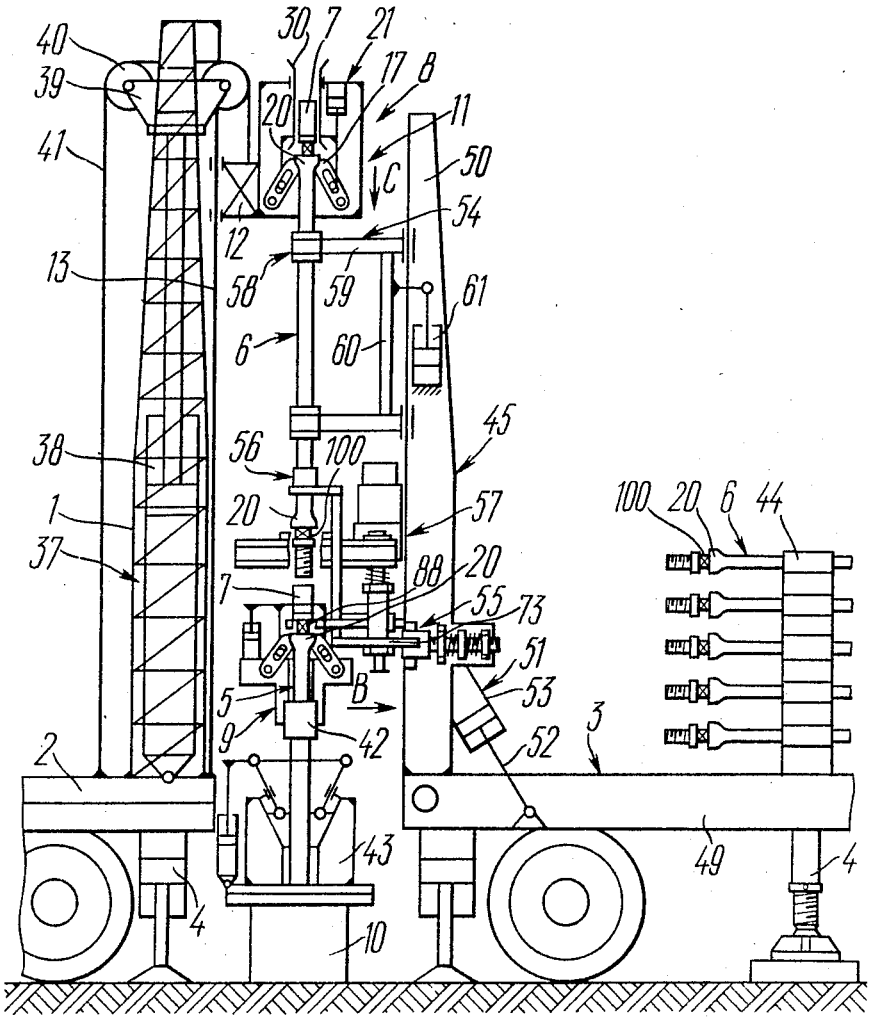
FIG. 1 is a diagrammatical representation of a well tubing handling apparatus of the invention.

A description of one embodiment of the invention that follows is that of an apparatus for handling well rods for servicing well pumps.

The apparatus comprises a mast 1 (FIG. 1) installed at a well bore on a movable platform 2 and a mobile frame 3 installed at the other side of the well bore. The platform 2 and the frame 3 are provided with stabilizing hydraulic jacks 4.

In order to suspend a string 5 consisting of well pump rods 6 having threaded ends interconnected with threaded sleeves 7 the apparatus is provided with an upper means 8 mounted on the mast 1 and a lower means 9 immovably arranged over the well head 10.

The upper means 8 for suspending the string 5 made up of the well rods 6 is a lifting frame 11 mounted on a carriage 12 adapted to be moved along the mast 1 on guides 13 especially provided on the same mast.

Figure 3:
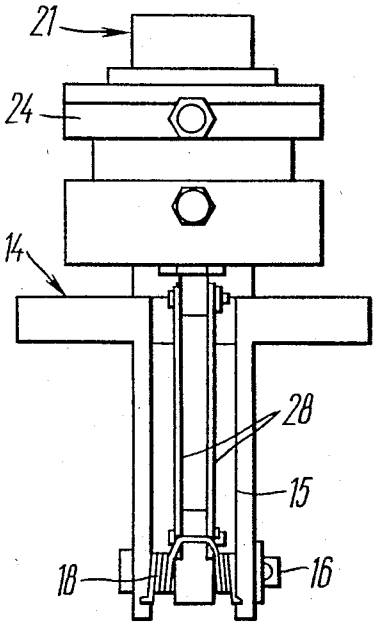
FIG. 3 is a view in the direction of arrow A in FIG. 2.

The lifting frame 11 includes a cross-piece 14 (FIGS. 2 and 3) having a cross-section substantially resembling the configuration of a portal (FIG. 3). Slots 15 on the crosspiece 14 receive clamp jaws 17 pivoted about pivot pins 16 and oppositely loaded by torsion springs 18. Faces 19 of the clamp jaws 17 are rounded off such that they are capable of clamping a well rod 6 at an upset head 20 to thereby prevent further downward movement of the well rod 6 with respect to the lifting frame.

The clamp jaws 17 are kinematically connected to a power cylinder or ram assembly 21 mounted on the cross-piece 14. The ram assembly 21 comprises a hollow plunger 22 with a collar portion 23 secured in an opening of the crosspiece 14 provided in a lateral portion of the portal and on the axis of symmetry of the slot and a sleeve assembly 24 mounted on a portion of the plunger 22 that extends above the cross-piece 14 and arranged for axial movement. The sleeve assembly 24 has a space 25 of a diameter corresponding to that of the collar portion 23 of the plunger 22 and adapted to be filled with a pressure fluid. Unions 26 and 27 serve to connect the space 25 with a hydraulic power system (not shown) of the apparatus. Articulated links 28 connect the sleeve assembly 24 to the clamp jaws 17 and pivot pins 29 connecting the links 28 to the jaws 17 are offset with respect to the pivot pins 16 towards the axis of the plunger 22 which in turn is aligned with the well bore when the apparatus is in position.

Apart from the ram assembly 21 the cross-piece 14 of the lifting frame 11 carries a means 30 for centering the upper end of the rod 6 with threaded sleeve 7 screwed onto the end.

The means 30 hereinafter referred to as a centering guide, is a bush having a bearing portion 31 and slipped on a downwardly extending portion of the plunger 22. The bush also has a centering collar 32 provided around the outer diameter of the threaded sleeve 7. The centering guide 30 is attached to the plunger 22 by a bayonet lock 33. Openings 34 in lugs 35 and 36 of the cross-piece 14 are intended for securing the latter on the carriage 12 (FIG. 1).

The upper means 8 for suspending the well string 5 is kinematically connected to a hoisting drive means 37 constructed as a hydraulic cylinder 38 with a hoist trolley 39 mounted on its piston rod. The hoist trolley 39 carries pulleys 40 with a cable 41 running thereover. One end of the cable 41 is anchored to the platform 2 and the other to the carriage 12 of the upper means 8. The hydraulic cylinder 38 is mounted on the platform 2 inwardly of the mast 1.

The above described lifting frame may be also used in any conventional well tubing handling apparatus. The centering guide as part of the lifting frame improves reliability in clamping the well string and makes the operation more safe apart from eliminating detachment of the well string and falling into the well bore.

On the other hand the apparatus of the invention is useful with any conventional elevator for well rods on condition that it may be constantly fixed on the carriage 12 while the centering guide of any conventional design may be independently secured on the carriage above the elevator and coaxially with the faces of the clamp members in a position assumed by these clamp members when they held the rod 6.

The lower means 9 for suspending the string 5 of well rods 6 is spider for rods mounted on a tubing string 42, which is positioned and clamped in a tubing spider 43 arranged on the well head 10.

Any suitable power-driven clamp may be used as a spider for well rods, for example, such as has been described hereabove as part of the lifting frame 11, but in this case the clamp jaws or other clamp members must be turned around through an angle of 90° with respect to the jaws 17 of the lifting frame 11.

Any conventional spider for pipes and having damp wedges may be used as the spider 43 for pipes.

The manner of mounting of the spider for well rods on the string 42 as hereinabove described is preferred but not the only one. The spider may be mounted on any stationary support structure above the well head 10.

Figure 4:
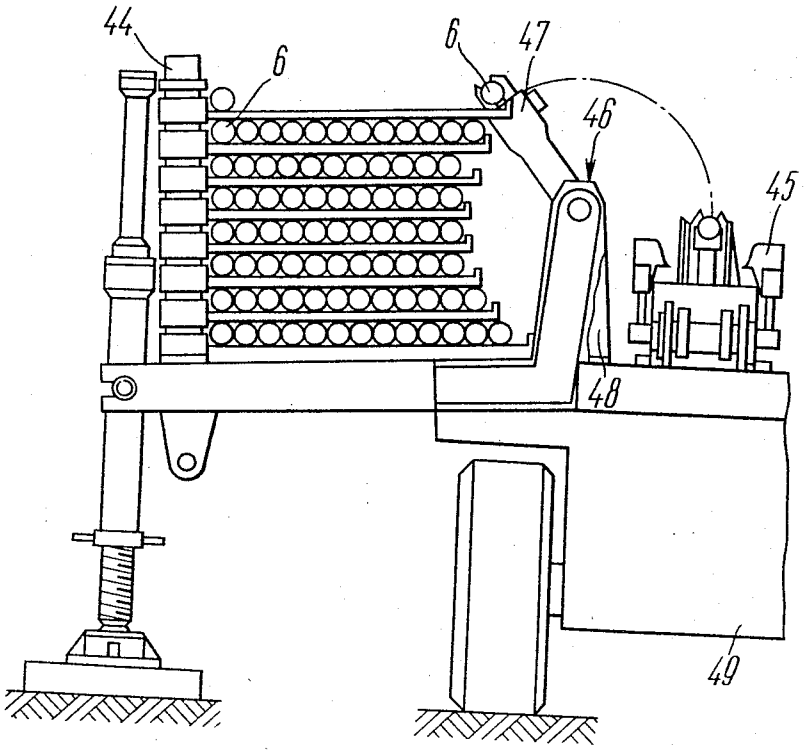
FIG. 4 is an enlarged view in the direction of arrow B in FIG. 1 of the manipulator boom in a horizontal position.

The apparatus also comprises a means for storing the well rods 6, which means is a rack 44 (FIGS. 1 and 4) having substantially horizontal shelves. The rack 44 is mounted on the frame 3 where a manipulator 45 is also arranged to transfer the well rods 6 between the rack 44 and the upper means 8 for holding the string 5 of the well rods 6 (FIG. 1). In the present embodiment of the invention the rods 6 are carried from the rack 44 into the manipulator 45 (the boom thereof being shown in a horizontal position in FIG. 4) by means of a device 46 for the transfer of the well rods 6 (FIG. 4), which device is a gripper 47 rotated on posts 48 carried on a base member 49 of the frame 3. For a more detailed description of the transfer device 46 and the rack 44 reference may be made to a copending application for "Automated apparatus for handling well elements in well" by Spetsialnoye konstruktorskoye byuro seysmicheskoi tekhniki.

The manipulator 45 (FIG. 1) comprises a boom 50 mounted on the base member for the manipulator 45 made integral with the base member 49 (FIG. 4) of the frame 3.

The boom 50 is rotatable in a vertical plane between a position when the drill rod 6 is transferred from the rack 44 by the transfer device 46 and an operating position when the rod 6 is axially aligned with the well bore (FIG. 1). To rotate the boom through a predetermined angle there is provided a drive 51 constructed as a hydraulic cylinder with a piston rod 52 pivoted to the base member 49 and a cylinder sleeve 53 pivoted to the boom 50.

The boom 50 carries a clamp means 54 for holding the rod 6 as it is transferred by the manipulator 45, a means 55 for gripping the upper end of a string 5 of the rods 6, a means 56 for gripping and centering the lower end of the rod 6, and a swivel head 57 for screwing and unscrewing the string 5 of the rods 6.

Figure 5:
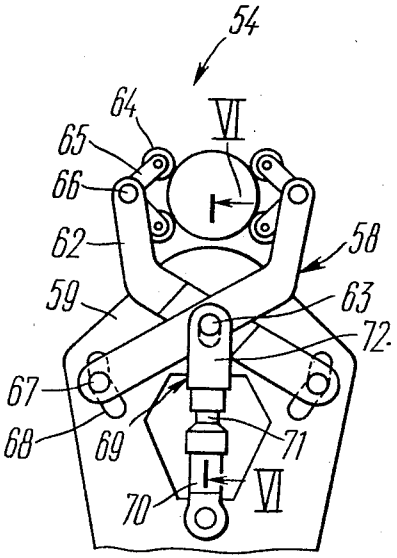
FIG. 5 is an enlarged view in the direction of arrow C in FIG. 1 (a rotated view)

The clamp means 54 comprises two or more power-driven lever grips 58 (FIG. 5) mounted on fixed members 59 rigidly secured on a frame 60 (FIG. 1) arranged on the boom 50 of the manipulator 45 for longitudinal displacement. To this end the boom 50 is provided with guides and a suitable drive 61 constructed as a hydraulic cylinder with a piston rod mechanically coupled to the frame 60. Each grip 58 comprises a pair of levers 62 (FIG. 5) coupled by a pivot pin 63.

Figure 6:
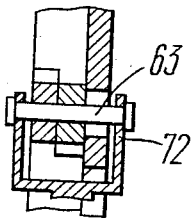
FIG. 6 is an enlarged sectional view along the line VI—VI in FIG. 5.

To clamp a rod there are provided rollers 64 arranged in pairs and held in claws 65 mounted for rocking motion about pivot pins 66, which are carried on the ends of the levers 62. The opposite ends of the same levers carry guide pins 67 extending through arcuate slots 68 provided in the fixed members 59. Each grip 58 has a drive 69 for closing the levers 62. The drive 69 comprises a hydraulic cylinder 70 with a piston rod 71 carrying a yoke 72 (FIG. 6) connected with the levers 62 by the common pivot pin 63.

The means 55 for gripping the upper end of the string 5 (FIG. 1) comprises a support 73 (FIGS. 7 and 8) mounted on the boom 50 of the manipulator 45 for lateral elastic displacement.

To this end a pair of spring hangers 78 is provided between the support 73 having a boss on the axis of symmetry if seen from above and the boom 50 having vertical lugs 74 with openings 75 and guides 76 with grooves 77 at the sides thereof.

Figure 9:
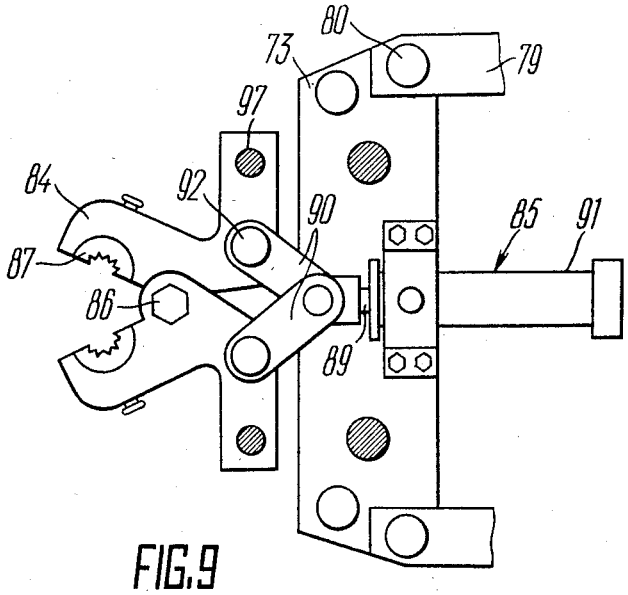
FIG. 9 is an enlarged sectional view along the line IX—IX in FIG. 7.

Each of the spring hangers 78 comprises a yoke 79 pivoted to the support 73 by a pivot pin 80 and having a threaded stem 81. The yoke 79 is received in a guiding groove 77 of the boom 50 and the stem thereof extends through an opening 75 in the lug 74. At both sides of the lug 74 on the threaded stem 81 there are springs 82 compressed against the end faces of the lug 74 by nuts 83. A pair of gripping jaws 84 (FIG. 9) is mounted on the support 73 of the means 55 which is a lock means. The gripping jaws 84 are kinematically connected with a drive 85 for closing the same jaws. The gripping jaws have the form of angular levers interconnected by a pivot pin 86 held on the support 73. One end of each of the above levers is operating while the other one is driven.

Figure 7:
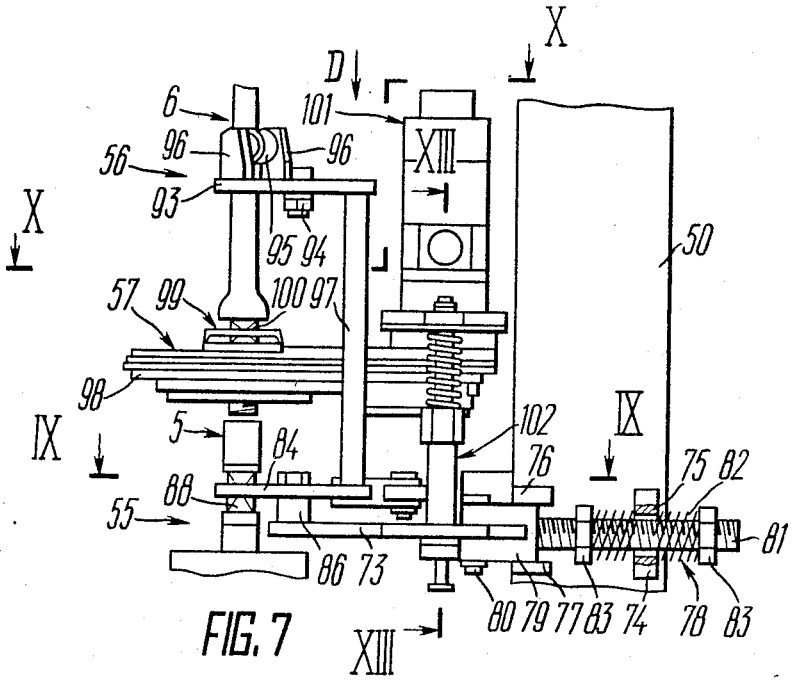
FIG. 7 is an enlarged diagrammatical view of an automatic tong assembly for making up and breaking out joints of well rods for use in the apparatus of the invention.

Operating ends of the jaws 84 have anti-slip inserts 87 which are provided with teeth on their operating surfaces for a reliable engagement with a square-section neck 88 on the string 5 (FIG. 7). The drive 85 (FIG. 9) is a hydraulic cylinder having a piston rod 89 connected to the jaws 84 through articulated links 90 while the cylinder sleeve 91 is connected to the support 73. The links 90 are connected to the jaws 84 through pivot pins 92 provided at the driven ends thereof.

The means 56 for gripping and centering the lower end of the rod 6 is a centering guide having centering jaws 93 (FIG. 8) interconnected by a pivot pin 94 and arranged above the swivel head 57 (FIG. 7).

The centering jaws 93 have the form of angular levers (FIG. 8) and each offer an operating end and a driven end. The operating ends of these levers carry centering rollers 95 received in supports of the posts 96 (FIG. 7) rigidly connected to the jaws 93. The rollers 95 (FIG. 8) are biconical. The jaws 93 are arranged so that in a closed position the operating surfaces of the rollers 95 define an opening, which is aligned with the opening defined by the anti-slip inserts 87 when the gripping jaws 84 (FIG. 9) are also in a closed position. The driven ends of the centering jaws 93 are rigidly connected to the driven ends of the gripping jaws 84 through vertical columns 97 (FIG. 7).

The swivel head 57 (FIG. 7) comprises a casing 98 mounted on the support 73 of the means 55 and adapted for longitudinal elastic displacement, a means 99 for gripping the neck 100 of the rod 6 is mounted on the casing 98, a power-driven reversible means 101 mounted substantially in the casing 98 and kinematically connected to the means 99, and a spring means 102 for holding the casing 98 of the swivel head 57 on the support 73 of the means 55 mechanically connected with the casing and the support.

The casing 98 is the casing of a reduction gear 103 (FIG. 10) constituting part of the reversible means 101 (FIG. 7) and has a slot 104 for the rod 6 (FIG. 10) to pass therethrough.

The reduction gear 103 has at least one pair of gear wheels of which the driven gear wheel 105 (FIG. 11) has a slot 106 for the same purpose.

Figure 11:
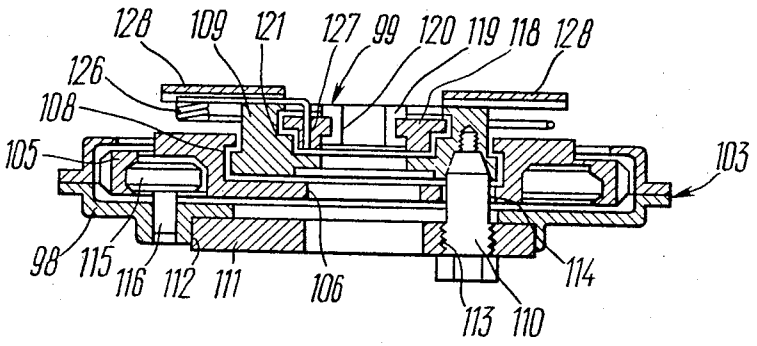
FIG. 11 is a sectional view along the line XI—XI in FIG. 10.

The driving gear wheel (not shown) of the reduction gear 103 is coupled to a reversible motor 107 installed in the casing 98. Within a recess 108 in the gear wheel 105 (FIG. 11) there is received a substructure 109 of the means 99 for gripping the neck 100 of the rod 6 to form a clearance between the recess wall and the substructure 109. The substructure 109 is rigidly connected with a braking washer 111 through a pin 110 (FIG. 11). The braking washer 111 is received in a recess 112 in the casing 98 and brought in contact with the bottom portion of the recess 112 by its end face 113.

Figure 10:
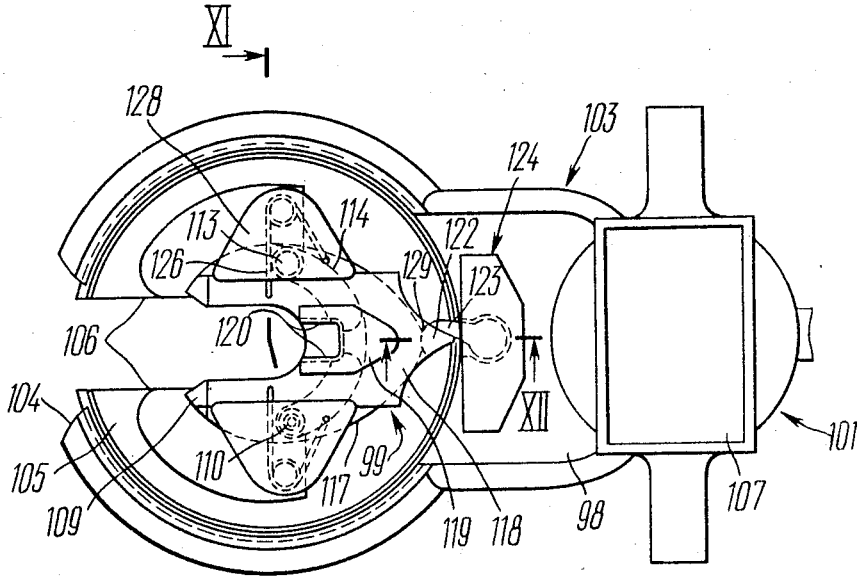
FIG. 10 is an enlarged sectional view along the line X—X in FIG. 7.

A pin 110 is passed through one of two holes 113 in the washer 111 and extends through one of two arcuate slots 114 provided in the gear wheel 105 (FIG. 10). The gear wheel 105 is rotatably mounted on support rollers 115 (FIG. 11) which are rotatable on axles 116 fixed in the casing 98. An eccentric 117 (FIG. 12) is provided on the upper end face of the gear wheel 105.

The means 99 for gripping the neck 100 of the rod 6 (FIG. 7) comprises a yoke 118 (FIG. 10) with a removable insert 119 having a mouth 120. The yoke 118 is movably received in a stepped groove 121 (FIG. 11). The yoke 118 has a pointed ridge 122 (FIG. 10) coacting with a stop 123 of an arrester 124 mounted in the casing 98.

Figure 12:
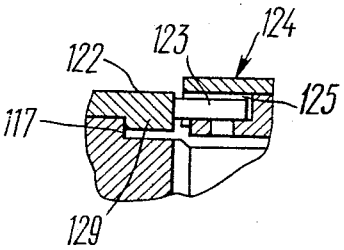
FIG. 12 is a sectional view along the line XII—XII in FIG. 10.

The stop 123 is held in a groove 125 of the casing 98 for rotation through an angle whereby this stop can coact with both sides of the pointed ridge 122 in turn (FIGS. 10, 12). The yoke 118 is constantly urged against the stop 123 by two torsion springs 126 (FIG. 10). One end of each spring 126 is connected to the casing 98 while the other one is received in an opening 127 in the yoke 118 (FIG. 11). The springs 126 are covered with caps 128 from above.

The arrester 124 together with the stop 123 is set out so that the mouth 120 is in register with the slot 106 in the gear wheel 105 and with the slot 104 in the casing 98 when the stop 123 comes in contact with the pointed ridge 122 of the yoke 118 (FIG. 10).

Underneath of the pointed ridge 122 of the yoke 118 there is provided a tooth 129 (FIGS. 10,12) coacting with the eccentric 117 of the gear wheel 105 on its side face.

Figure 13:
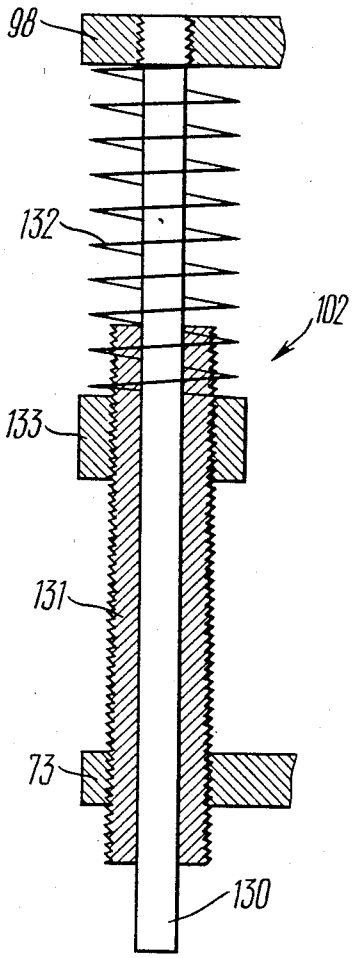
FIG. 13 is an enlarged sectional view along the line XIII—XIII in FIG. 7.

The spring means 102 (FIG. 7) includes two guiding columns 130 (FIG. 13) rigidly connected to the casing 98, posts 131 each having the form of a bush externally threaded and screwed into the support 73 of the means 55 and having inner openings to the diameter of the guiding columns 130, as well as compression springs 132 and nuts 133. The columns 130 are received in the openings of the posts 131 and the nuts 133 are screwed on the threaded portion of the posts 131 and hold the springs 132 on the columns 130 pressed against the end face of the casing 98 to threreby provide for longitudinal displacement of the latter with respect to the support 73 of the means 55.

The above described swivel head 57, the means 55 for gripping the upper end of the string 5 of the rods 6, and the means 56 for gripping and centering the lower end of the rod 6 all mounted substantially on the single support 73 provide an automatic tong assembly for making up and breaking out joints of a well string. The tong assembly may be used, apart from the apparatus just described, in an apparatus designed for the same purpose but of a conventional structural organization. However, the means for gripping and centering the lower end of the rod in the novel tong assembly makes the same advantageously different from the conventional assemblies in that the well rod to be added to a well string and the same well string are accurately aligned. This feature makes is possible to increase the speed of rotation of the rod in screwing and unscrewing the well string, to minimize damage to the threaded portion of a rod in operation, to provide conditions for a more rapid lowering of a rod while making screw joints by the sleeve 7 screwed on the upper end of the string 5.

It is to be noted that in the above described apparatus use may be made of an automatic tong assembly of any conventional design. In such case if the tong assembly used comprises only the swivel head then the means for gripping the upper end of the well string and the means for gripping and centering the lower end of the rod both constructed according to the invention should be mounted on the manipulator boom independently of the tong assembly, while the tong assembly may be mounted directly on the manipulator boom so as to have the freedom of longitudinal elastic displacement with respect to the means for gripping the upper end of the well string. Likewise, if the conventional tong assembly comprises a swivel head and a lock means for gripping the upper end of the string, then the means for gripping and centering the lower end of the rod may be independently mounted on the manipulator boom so as to be free to perform lateral elastic displacements and in this case the same means should be mechanically connected to the lock means of the tong assembly employed so that working surfaces of both lock means and the means for gripping and centering the rod are in alignment when they come in contact with the rod.

The above described apparatus for handling the well pump rods operates as follows.

By operating the stabilizing hydraulic jacks 4 (FIG. 1) the platform 2 and the frame 3 are positioned so that the upper means 8 for suspending the string 5 of the rods 6 and grippers 58 of the clamp means 54 (the boom 50 of the manipulator 45 being in a vertical position) are in alignment with the well bore.

Prior to lowering the string 5 of the rods 6 into the well bore the mechanisms of the apparatus assume the following position: the upper means 8 for holding the string 5 of the rods 6 together with the means 30 for centering the upper end of the rod 6 are in their lower position, the bottom 50 of the manipulator 45 is in a horizontal position, the lever grippers 58 of the clamp means 54 are open, the yoke 118 of the swivel head 57 is swung away (FIG. 10) and its mouth 120 is in register with the slots 104 and 106 of the casing 98 and the gear wheel 105 respectively, the gripping jaws 84 (FIG. 9) and the centering jaws 93 (FIG. 8) of the means 55 and 56 respectively (FIGS. 1 and 7) are open, the gripper 47 of the transfer device 46 (FIG. 4) is brought to the storage rack 44, the string 5 of the rods 6 (FIG. 1) is clamped in the lower means 9 arranged on the string 42 of the pipes for servicing well pumps, the pipes being held by the spider 43.

On actuating the drive (not shown) of the gripper 47 of the transfer device 46 (FIG. 4) one rod 6 from the storage rack 44 is transferred to the manipulator 45 and is placed into the lever grippers 58 of the clamp means 54 (FIG. 1) so that the threaded end of the rod 6 is received in the slots 104 and 106 (FIG. 10) now in register. By the action of the hydraulic cylinders 70 (FIG. 5) the levers 62 of the grippers 58 are brought together.

At the same time the grips of the gripper 47 (FIG. 4) are opened and the same gripper is turned in the direction or toward the storage rack 44 to assume a loading position to receive another rod 6. Thereafter the drive 51 (FIG. 1) turns the boom 50 relative the base member 49 (FIG. 4) on the frame 3 into an operative (vertical) position (FIG. 1). Now the rod 6 is aligned with the well bore. The hydraulic cylinder 38 simultaneously drives the hoist trolley 39 upwardly whereby the carriage 12 of the upper means 8 with lifting frame 11 is driven up along the guides 13 on the mast 1 by the cable 41 running around the pulleys 40. Pressure fluid supplied to upper portion of the space 25 in the sleeve 24 through the union 26 drives the sleeve 24 upwardly in respect to the fixed plunger 22 and the clamping jaws 17 drawn by the links 28 turn about the pins 16 to assume an open position.

By the action of the drive 85 (FIG. 9) the gripping jaws 84 of the means 55 for gripping the upper end of the string 5 of the rods 6 are brought together and the support 73 is positioned with respect to the boom 50 (FIG. 8) due to lateral displacement under the action of the springs 82 of the spring hangers 78. As the jaws 84 close, the centering jaws 93 (FIG. 8) are closed too under the action of the vertical columns 97 (FIG. 7) to attain an accurate alignment of the rod 6 held by the clamp means 54 (FIG. 1) and the string 5 held by the lower means 9. Under the action of the hydraulic cylinder 38 and the hoist trolley 39 and carriage 12 together with the lifting frame 11 is lowered so that the upper end of the rod 6 passes between the clamp jaws 17 held in an open position (FIG. 2) and the sleeve 7 on the rod 6 enters into the centering guide 30. In doing this the lifting frame 11 is stopped as soon as the clamp jaws 17 are found below the upset head 20 of the rod 6 by the distance not shorter than that between the lower end face of the rod 6 and the upper end face of the string 5. Now the pressure fluid is supplied into the lower portion of the space 25 in the sleeve 24 through the union 27, the sleeve 24 is lowered and the jaws are closed to embrace the cylindrical portion of the rod 6 with a rod-to-jaw clearance.

The drive 61 (FIG. 1) causes the clamp means 54 together with the rod 6 held in grips 58 to go downward until the lower end face of the rod 6 abuts the threaded portion of the sleeve 7 on the upper end of the string 5. Now the hydraulic cylinder 70 (FIG. 5) brings the grips 58 to an open position and the rod 6 is released therefrom but remains held by the centering guide 30 and the means 56 to prevent lateral displacement. By energizing the reversible motor 107 (FIG. 10) of the swivel head 57 (FIG. 7) the driven gear wheel 105 of the reduction gear 103 (FIG. 11) is rotated. When the gear wheel 103 makes a turn equal to the length of the slot 114 (FIG. 10) the pin 110 remains immovable because it is held by the braking washer 111. The substructure 109 carrying the yoke 118 of the means 99 connected to the washer 111 by the pin 110 is also immovable. Therefore the eccentric 117 (FIG. 10) on the gear wheel 105 moves in relation to the tooth 129 of the pointed ridge 122 of the yoke 118 to cause the latter be displaced in the stepped groove 121 (FIG. 11) under the action of the springs 126 toward the axis of the rod 6 (FIG. 1) held in the lever grippers 58 of the boom 50.

Figure 2:
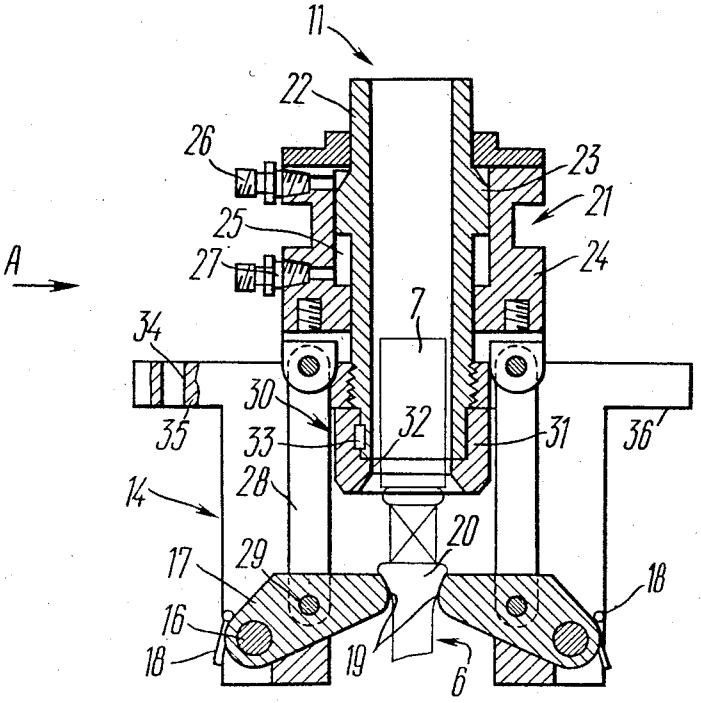
FIG. 2 is an enlarged frontal view in section of a frame for lifting well rods for use in the apparatus of the invention.

As soon as the gear wheel 105 having turned the angular amount mentioned (FIG. 10) abuts the pin 110 (FIG. 11) the braking washer 111 overcomes friction forces between the end face and the bottom of the recess 112 in the casing 98, starts rotation to carry the substructure 109 with the yoke 118 and therefore to rotate the rod 6. As the string 5 is assembled by screwing, the casing 98 (FIG. 7) is carried downwardly by the rod 6 being screwed on. The columns 130 (FIG. 13) make sliding motion inside the posts 131 and the springs 132 of the spring means 102 are compressed and the rod 6 slips between the faces 19 of the clamp jaws 17 of the lifting frame 11 (FIG. 2).

As soon as a required torque is developed a safety device (not shown) connected with the motor 107 operates to reverse the motor 107 (FIG. 10) for a short-time period. The gear wheel 105 (FIG. 1) is reversed through an angle corresponding to the length of the slot 114 (FIG. 10) but the pin 110(FIG. 11) remains immovable because it is held by the braking washer 111 in contact with the casing 98. The substructure 109 is also immovable and prevents turning of the yoke 118 therefore the tooth 129 slides over the surface of the eccentric 117 (FIGS. 10 and 12). The gear wheel 105 drives the yoke 118 along the stepped groove 121 (FIG. 11) against the action of the springs 126. In this case the rod 6 is released, that is the contact with the surfaces of the mouth 120 in the yoke 118 (FIG. 10) is broken. As the gear wheel 105 is further reversed the braking washer 111 (FIG. 11) together with the substructure 109 and the yoke 118 rotates in the same direction and the pointed ridge 122 (FIG. 10) of the yoke 118 runs over the stop 123 and stops to produce a position when the mouth 120 of the yoke 118 is registered with the slots 104 and 106 of the casing 98 and the gear wheel 105 respectively.

Following the stopping of the swivel head 57 (FIG. 7) the drive 85 (FIG. 9) causes the gripping jaws 84 and the centering jaws 93 (FIG. 8) to open and then the drive 51 (FIG. 1) turns the boom 50 of the manipulator 45 into a horizontal position. Now the hydraulic cylinder 38 and the hoist trolley 39 raise the carriage 12 with the lifting frame 11 and the centering guide 30 until the clamp jaws 17 (FIG. 2) abut the head 20 of the rod 6. The lifting frame 11 having clamped the string 5 by the jaws 17 raises the same string of rods until the clamps of the lower means 9 (FIG. 1) are found below the head 20 and then the clamp drive opens these clamps. By supplying pressure fluid into the hydraulic cylinder 38 the piston rod thereof is lowered and the hoist trolley 39 and the carriage 12 of the upper means 8 assume a lower position to drive the string 5 into the well bore. As soon as the joint of the string 5 (consisting of the sleeve 7 and the upset heads 20 on the rods 6) passes the clamps of the lower means 9 these clamps are closed and the string 5 under the action of the lifting frame 11 continues to descend until it abuts with its head 20 the clamps of the upper means 9. The string 5 stops and the lifting frame 11, whose clamping jaws 17 (FIG. 2) are turned through an angle of 90° with respect to the clamps of the lower means 9 (FIG. 1), continues to descend until the jaws 17 (FIG. 2) are found below the head 20 whereafter the jaws are opened by the action of the hydraulic cylinder 21. In this position the apparatus is ready to procede with another operating cycle.

When the string 5 is to be raised from the well bore the apparatus operates as follows.

The jaws 17 are closed by the hydraulic cylinder 21 and the hydraulic cylinder 18 (FIG. 1) and the hoist trolley 39 begin to raise the upper means 8 together with the string 5 held in the lifting frame 11. As the string 5 is raised the clamps of the lower means 9 are open in order to let the joint of the string 5 pass therebetween. As soon as the upper head 20 of the second of the top rods 6 is found above the clamps of the lower means 9 the clamps are closed, the string 5 is lowered until the head 20 abuts the clamps of the lower means 9 and the same lower means takes up the weight of the string 5. The lifting frame 11 is further lowered until the clamping jaws 17 (FIG. 2) are found below the head 20 of the upper rod 6 and the upper means 8 (FIG. 1) is stopped. The boom 50 of the manipulator 45 is turned into an operative position by the drive 51 with the result that the open grips 58, slots 104 and 106 (FIG. 10) of the swivel head 57, the open gripping jaws 84 (FIG. 19), and the centering jaws 93 (FIG. 8) approach the string 5.

The drive 85 (FIG. 9) closes the gripping jaws 84 and the centering jaws 93. By energizing the motor 107 (FIG. 10) the gear wheel 105 is rotated in the direction to unscrew the string 5, at the same time, while the gear wheel 105 rotates through an angle defined by the length of the slot 114, the yoke 118 approaches the neck 100 of the rod 6 to be unscrewed to encompass the neck with the mouth 120. Then the gear wheel 108, through the pin 110 (the pin 110 in this mode of operation is inserted into the hole 113 in the washer 111 and extends through the slot 114 in the gear wheel 105) and the substructure 109, rotates the yoke 118. As soon as a minimum torque is developed the safety device reverses the motor 107 for a short-time period. As the gear wheel 105 is being reversed the yoke 118 assumes a starting position and is rotating together with the gear wheel 105 to reach the stop 123 whereupon the rotation is stopped. It is to be noted here that the initial position of the stop 123 with respect to the axis of the mouth 120 in the yoke 118 in different from that when the string 5 is screwed, that is the stop is turned into a position wherein a reverse side of the pointed ridge 122 is brought in contact therewith. The rod 6 that has been unscrewed and raised together with the swivel head 57 (FIG. 1) is clamped by the lever grips 58 of the manipulator 45. Then the hydraulic cylinder 21 (FIG. 2) opens the clamp jaws 17 and the upper means 8 is raised by the hydraulic cylinder 38 and the hoist trolley 39 as high as is necessary to release the rod 6 from the upper means 8.

Figure 8:
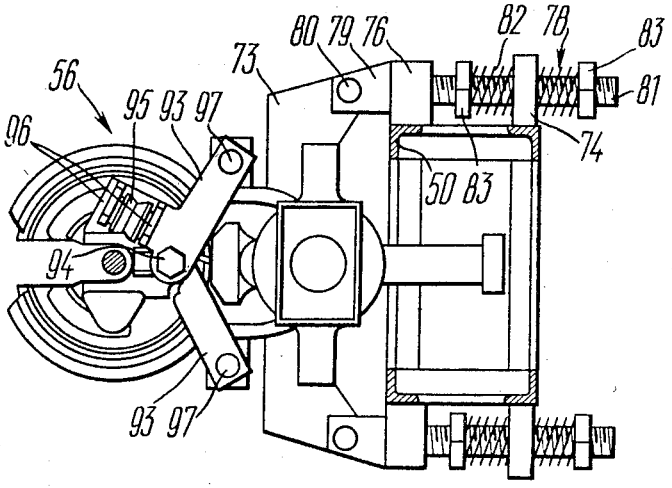
FIG. 8 is a view in the direction of arrow D in FIG. 7.

At the same time the drive 85 (FIG. 9) opens the gripping jaws 84 and the centering jaws 93 (FIG. 8). The drive 61 (FIG. 1) raises the frame 60 of the clamp means 54 together with the rod 6 clamped therein until the lower end of the rod 6 is readily released from the sleeve 7. The drive 51 turns the boom 50 into a horizontal position and then the gripper 47 (FIG. 4) is moved toward the rod 6 clamped in the clamp means 54. The clamps of this means are closed and the lever grips 58 are open (FIG. 5) and the gripper 47 (FIG. 4) transfers the rod 6 onto the rack 44. Following this the grips of the gripper 47 release the rod 6. At the same time the boom 50 (FIG. 1) is turned to cause lowering the upper means 8 by the hydraulic cylinder 38 and the hoist trolley 39.

In this position the apparatus of the invention is ready for another cycle of raising the string 5.

The above described apparatus is structurally simple, offers high efficiency and is reliable in operation. The lifting frame forming part of the apparatus offers a reliable grip on the drill string and a safe operation sequence for the operating personel. The automatic tong assembly used in the apparatus provides for a higher speed of screwing and unscrewing the well string.

It is, however, should be kept in mind that though the apparatus as hereinbefore described is designed for handling the pumping rods, the invention is not limited to this application.

The invention can be embodied in an apparatus for handling other elongated well elements, such as drill pipes or tubing. In particular, the latter application may be effected with the upper means for suspending a tubing string comprising any conventional lifting frame or elevator for pipes. In this case the means for centering the upper end of a pipe will be made integral with the clamping device of the elevator. Accordingly, to screw and unscrew a string of pipes there may be used conventional devices designed for this particular purpose. In a particular case such an apparatus may be of a design similar to that disclosed in U.S. Pat. No. 3,545,313, U.S. Cl. 81-57.34 on condition that the device for rotating pipes, which forms part of the apparatus covered by this patent, is constructed as a corresponding unit of the apparatus disclosed in U.S. Pat. No. 4,023,449, U.S. Cl. 81-57.16 (this unit is designated by a reference numeral 18 in the pertinent specification). In this case the device for rotating pipes functions both as a swivel head and as a means for gripping and centering the lower end of a pipe.

It is to be however understood that various modifications may be made in the invention without departing from the spirit and scope thereof and as defined in the appended claims.

What is claimed is:

1. An apparatus for handling elongated well elements, such as well rods, made up in a well string by means of screw joints, said apparatus comprising:

a mast arranged at a well bore and having longitudinal guides, upper means for suspending a well string of elongated well elements, said upper means being movably mounted on said mast, centering guide means for centering the upper end of an elongated well element, said centering guide means being movably mounted on the longitudinal guides of said mast, hoisting means kinematically connected to said upper means for suspending a well string of elongated well elements, lower means for suspending a well string of elongated well elements, said lower means being immovably mounted above a well head, storing means for storing elongated well elements arranged beside the well head, a manipulator for moving an elongated well element between said storing means and said upper means, said manipulator including a base member arranged adjacent the well head, a boom mounted on said base member for rotation between a position of moving an elongated well element off said storing means and an operating position where the elongated well element is aligned with the well bore, a rotary drive mounted on said base member and kinematically connected to said boom, clamp means for holding an elongated well element as said elongated well element is transferred by said manipulator from said storing means to said operating position, said clamp means being mounted on said boom and having coaxial grippers spaced along said boom, gripping means for gripping the upper end of a string of elongated well elements, said gripping means being mounted on said boom for lateral elastic displacement so that with said boom in said operating position said gripping means is disposed between said clamp means and said lower means, said gripping means having at least one pair of power-driven gripping jaws arranged so as to define an opening in their closed position, said opening being substantially coaxial with the coaxial grippers of said clamp means, means for gripping and centering the lower end of an elongated well element, said means for gripping and centering being mounted on said boom for lateral elastic displacement between said clamp means and said gripping means and having at least one pair of power-driven centering jaws, said means for gripping and centering being mechanically coupled to said gripping means so that openings defined by the jaws of said gripping means and said means for gripping and centering, on closing, are coaxial, and a swivel head for screwing and unscrewing a string of elongated well elements, said swivel head being mounted on said boom for longitudinal elastic displacement with respect to the gripping means.

* * * * *